United States Patent [19]

Shinohara et al.

[11] Patent Number: 4,645,998

[45] Date of Patent: Feb. 24, 1987

[54] CONSTANT VOLTAGE GENERATING CIRCUIT

[75] Inventors: Hirofumi Shinohara; Katsuki Ichinose, both of Itami, Japan

[73] Assignee: Mitsubishi Denki Kabushiki Kaisha, Tokyo, Japan

[21] Appl. No.: 770,426

[22] Filed: Aug. 29, 1985

[30] Foreign Application Priority Data

Oct. 26, 1984 [JP] Japan ..... 59-226293

[51] Int. Cl.[4] ..... G05F 3/20

[52] U.S. Cl. ..... 323/313; 307/296 R; 307/304

[58] Field of Search ..... 323/313–316; 307/296 R, 297, 270, 288, 313, 304

[56] References Cited

U.S. PATENT DOCUMENTS 3,806,742 4/1974 Powell ..... 323/313 X
4,020,367 4/1977 Yamashiro et al. ..... 307/297
4,460,864 7/1984 Ray ..... 323/313

FOREIGN PATENT DOCUMENTS 0549795 5/1977 U.S.S.R. ..... 323/313

OTHER PUBLICATIONS

"An Experimental 1Mb DRAM with On-Chip Voltage Limiter", Kiyoo Itoh. et al., ISSCC84, Digest of Technical Papers, Feb. 24, 1984, pp. 282–283.

*Primary Examiner*—Peter S. Wong
*Attorney, Agent, or Firm*—Lowe Price Leblanc Becker & Shur

[57] ABSTRACT

A constant voltage generating circuit comprises a power supply terminal (1), an output terminal (2), a p-channel MOS FET (3), n-channel MOS FET's (4 and 5) and resistors (8 and 9). A node C of the resistors (8) and (9) is connected to a control terminal of the n-channel MOS FET (4), whereby the potential in the output terminal (2) is determined mainly by the threshold voltage of the n-channel MOS FETs (4) and (5), a ratio of the resistance values of the resistors (8) and (9) and a degree of conduction of the n-channel MOS FET (4). Instead of the resistors (8) and (9), n-channel MOS FET's (10 and 11) may be provided so as to compensate for the influence of power supply voltage in the output voltage by changing the impedance of the n-channel MOS FET (10) according to the change of the voltage of the power supply terminal (1).

8 Claims, 6 Drawing Figures

CONSTANT VOLTAGE GENERATING CIRCUIT

BACKGROUND OF THE INVENTION

1. Field of the Invention

The present invention relates to a constant voltage generating circuit and particularly to an improvement of a constant voltage generating circuit formed by field effect transistors.

2. Description of the Prior Art

Generally, a constant voltage generating circuit is a circuit for maintaining output voltage constant even if power source voltage is changed. Such a constant voltage generating circuit is shown for example in "An Experimental 1 Mb DRAM with On-Chip Voltage Limiter" by Kiyoo Itoch et al. in ISSCC84, Digest of Technical Papers, page 282. FIG. 1 is a circuit diagram showing a conventional constant voltage generating circuit formed by MOS filed effect transistors (MOS FET's). First, the structure of the conventional constant voltage generating circuit shown in FIG. 1 will be described. In FIG. 1, power supply voltage $V_{cc}$ is applied to a terminal 1 and constant voltage $V_{OUT}$ is provided from a terminal 2. The power supply voltage $V_{cc}$ applied to the terminal 1 is supplied to the source of a p-channel MOS FET 3 and the drain of the p-channel MOS FET 3 is connected to the drain of a n-channel MOS FET 4 and to the output terminal 2 via a node A. The gate of the p-channel MOS FET 3 is grounded. Further, the source of the n-channel MOS FET 4 is also grounded. These MOS FET's 3 and 4 form an output portion of the constant voltage generating circuit, in which the p-channel MOS FET 3 functions as pull-up means for pulling the output voltage to the power supply voltage $V_{cc}$ and the n-channel MOS FET 4 functions as pull-down means for pulling the output voltage to the grounding potential.

Between the node A of the p-channel MOS FET 3 and the n-channel MOS FET 4 and the grounding potential, n-channel MOS FET's 5 and 6 and a resistor 7 having a resistance value R1 are connected in series. The n-channel MOS FET's 5 and 6 have their gates connected to their drains respectively. A node B2 between the source of the n-channel MOS FET 6 and the resistor 7 is connected to the gate of the n-channel MOS FET 4. These n-channel MOS FET's 5 and 6 and resistor 7 form an output control portion of the constant voltage generating circuit.

Now, description will be given to the operation of the conventional constant voltage generating circuit shown in FIG. 1. The resistance value R1 of the resistor 7 is set to a value considerably higher than a resistance value of the conducted n-channel MOS FET's 5 and 6 and as a result, the n-channel MOS FET's 5 and 6 are stable in a boundary state between the non conductive state and the conductive state. Therefore, the potential $V_{B1}$ at a node B1 between the source of the n-channel MOS FET 5 and the drain of the n-channel MOS FET 6 is a value obtained by subtracting the threshold voltage $V_{THT5}$ of the n-channel MOS FET 5 from the gate potential of the n-channel MOS FET 5, that is, $V_{OUT}$ and this value is expressed by the following equation.

$$V_{B1}=V_{OUT}-V_{THT5} \quad (1)$$

The potential $VB_2$ at the node B2 between the source of the n-channel MOS FET 6 and the resistor 7 is a value obtained by subtracting the threshold voltage $V_{THT6}$ of the n-channel MOS FET 6 from the gate potential of the n-channel MOS FET 6, that is, $V_{B1}$ and is expressed by the following equation.

$$V_{B2}=V_{B1}-V_{THT6} \quad (2)$$

By substituting the equation (1) into the equation (2) to eliminate $V_{B1}$, the below indicated equation is obtained.

$$V_{B2}=V_{OUT}-(V_{THT5}+V_{THT6}) \quad (3)$$

On the other hand, the p-channel MOS FET 3 is always in the conducted state since the gate thereof is grounded, and the impedance thereof is set to a value higher than the impedance of the n-channel MOS FET 4 in the conducted state. However, the impedance of the p-channel MOS FET 3 cannot be made as large as the resistance value R1 of the resistor 7 because the p-channel MOS FET 3 is generally required to drive a large load connected to the output terminal 2. Consequently, the n-channel MOS FET 4 is stable in a slightly conducted state and the gate potential thereof, that is, $V_{B2}$ is expressed by the below indicated equation.

$$V_{B2}=V_{THT4}+\alpha \quad (4)$$

where $V_{THT4}$ is threshold voltage of the n-channel MOS FET 4 and $\alpha$ is a value representing a degree of conduction of the n-channel MOS FET 4, this value $\alpha$ depending on a ratio between the impedance of the p channel MOS FET 3 and the impedance of the n=channel MOS FET4.

By eliminating $V_{B2}$ based on the equation (3) and (4), $V_{OUT}$ is represented as follows.

$$V_{OUT}=V_{THT4}+V_{THT5}+V_{THT6}+\alpha \quad (5)$$

Therefore, as indicated in the equation (5), the output voltage $V_{OUT}$ is represented as the sum of the threshold voltages of the respective MOS FET's, not depending on the power supply voltage $V_{cc}$ and constant voltage is generated at the output terminal 2.

However, in order to set a desired output voltage $V_{OUT}$ in a conventional constant voltage generating circuit thus structured, it is necessary to set threshold voltages of the respective MOS FET's by adjusting the ion implantation amount in the channel portions of the MOS FET's, and using this method, the manufacturing process of a constant voltage generating circuit becomes extremely complicated.

In case where a constant voltage generating circuit is formed only by the MOS FET's all having the same threshold voltage, output voltage $V_{OUT}$ can be increased or decreased by removing the n-channel MOS FET 5 or 6, or by further providing a MOS FET in series with the n-channel MOS FET's 5 and 6. However, the output voltage in this case is made only an integer multiple of the above stated same threshold voltage and cannot be set to other voltage values.

Further, in such a conventional constant voltage generating circuit thus structured, an absolute value $|V_{OUT}-V_{cc}|$ of the gate-source voltage of the p-channel MOS FET 3 is increased when the power supply voltage $V_{cc}$ changes to be high and in consequence, the impedance of the p-channel MOS FET 3 is decreased. More specifically, when the power supply voltage $V_{cc}$ increases, $\alpha$ also increases. Accordingly, as is obvious from the equation (5), the output voltage $V_{OUT}$ depends somewhat on the power supply voltage $V_{cc}$ and constant voltage cannot be supplied by the constant voltage generating circuit. Such dependency of the output voltage $V_{OUT}$ on the power supply voltage $V_{cc}$ is also indicated as the experimental data in the above stated paper written by Kiyoo Itoh et al.

SUMMARY OF THE INVENTION

Briefly stated, the present invention is a constant voltage generating circuit comprising: power supply means; means for supplying reference potential; a voltage output terminal for providing regulated constant voltage; pull-up means connected between the power supply means and the voltage output terminal for pulling up the output voltage; pull-down means connected between the reference potential supply means and the voltage output terminal and having a control terminal for pulling down the output voltage; and at least two resistance means connected in series between the reference potential supply means and the voltage output terminal, a node of said at least two resistance means being connected to the control terminal of the pull-down means.

According to another aspect of this invention, the above stated at least two resistance means each comprise a field effect transistor having a control terminal connected to a voltage in the vicinity of the voltage of the power supply means.

According to a further aspect of this invention, a ratio of the impedance values of the above stated at least two resistance means, that is, a ratio of the impedance of the resistance means connected on the side of the voltage output terminal to the impedance of the resistance means connected on the side of the reference potential supply means is made to change in inverse relation to the change of the power supply voltage.

Therefore, a principal object of this invention is to provide a constant voltage generating circuit in which desired output voltage can be set by a simple manufacturing process.

Another object of this invention is to provide a constant voltage generating circuit in which output voltage can be set to continuous values.

Further object of this invention is to provide a constant. voltage generating circuit in which constant output voltage can be obtained irrespective of the change of the power supply voltage.

A principal advantage of this invention is that output voltage depends on the ratio of the impedance values of the resistance means connected in series in an output control portion.

Another advantage of this invention is that the impedance of the resistance means can be set easily to continuous values by selection of geometrical figures for the elements forming the resistors.

A further advantage of this invention is that when the power supply voltage changes, the impedance ratio of the resistance means in the output control portion changes according to this change, whereby compensation is made for the influence of the change of the power supply voltage exerted on the output voltage.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
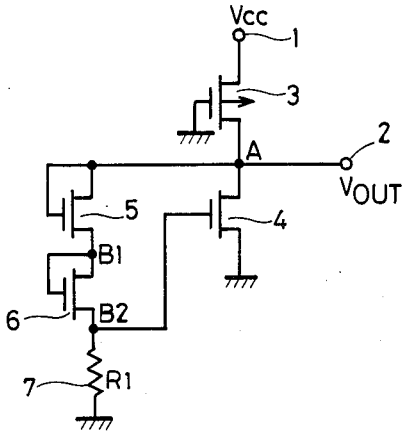
FIG. 1 PRIOR ART
FIG. 1 is a circuit diagram showing a conventional constant voltage generating circuit.
Figure 2:
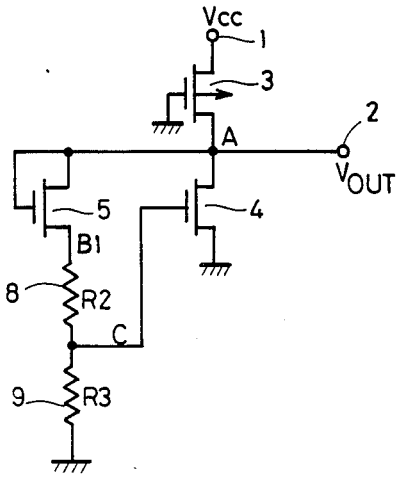
FIG. 2 is a circuit diagram showing a constant voltage generating circuit of an embodiment of this invention.

FIG. 2 is a circuit diagram showing a constant voltage generating circuit of an embodiment of this invention. The structure of the embodiment shown in FIG. 2 is the same as the structure of the conventional constant voltage generating circuit shown in FIG. 1, except for the below described points. Instead of the n-channel MOS FET 6 and the resistor 7, a resistor 8 having a resistance value R2 and a resistor 9 having a resistance value R3 are provided and connected in series and the node C of both resistors is connected to the gate of the n-channel MOS FET 4.

In the following, the operation of the embodiment of this invention shown in FIG. 2 will be described. The resistance values of the resistors 8 and 9 are set to values by far larger than the impedance of the conducted n-channel MOS FET 5 in the same manner as in the resistor 7 in FIG. 1 and therefore, the above stated equation (1) is also established in this case. The potential $V_c$ at the node C is expressed by the below indicated equation because of the voltage division of the $V_{B1}$ by the resistors.

$$V_c=[(R3)\cdot\{(R2)+(R3)\}]\cdot V_{B1} \tag{6}$$

Since the structure of the output portion formed by the p-channel MOS FET 3 and the n-channel MOS FET 4 is the same as that of the output portion in the circuit of FIG. 1, the following equation is established in the same manner as in the equation (4).

$$V_c=V_{THT4}+\alpha \tag{7}$$

By eliminating $V_c$ and $V_{B1}$ from the above stated equations (1), (6) and (7), the following equation is obtained.

$$V_{OUT}=V_{THT5}+[1+\{(R2)/(R3)\}]\cdot(V_{THT4}+\alpha) \tag{8}$$

As is obvious from the equation (8), the output voltage $V_{OUT}$ of the output terminal 2 depends on the ratio of the resistance values of the resistors 8 and 9. Since these resistance values can be set to desired values by suitably selecting geometrical figures for the elements forming the resistors, the output voltage $V_{OUT}$ can be set to continuous values without applying a complicated manufacturing process.

Figure 3:
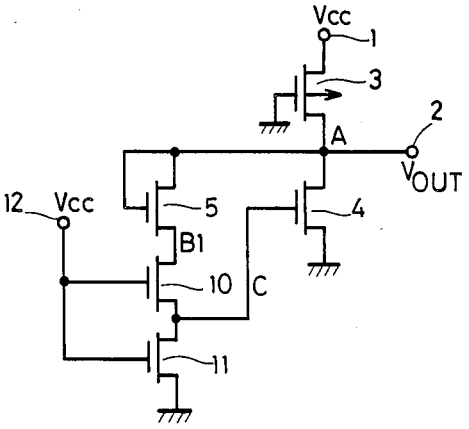
FIG. 3 is a circuit diagram showing a constant voltage generating circuit of another embodiment of this invention.

FIG. 3 is a circuit diagram showing a constant voltage generating circuit of another embodiment of this invention. In this circuit, the resistors 8 and 9 in the embodiment of FIG. 2 are replaced by n-channel MOS FET's 10 and 11. To the respective gates of these n-channel MOS FET's 10 and 11, power supply voltage $V_{cc}$ is applied from the power supply terminal 12 and in consequence, these n-channel MOS FET's 10 and 11 both are always in the conducted state and accordingly they serve as a kind of resistors. In this case, since the n-channel MOS FET 4 is required to drive a large load connected to the output terminal 2 as well as to decrease the consumption of electric power in the output control portion, the impedance values of the n-channel MOS FET's 10 and 11 are set to values larger than the impedance values of the n-channel MOS FET's 4 and 5. This setting of the impedance values can be achieved by making the ratio of the gate width W and the gate length L (W/L) of the n-channel MOS FET's 10 and 11 smaller than the ratio of the gate width W and the gate length L(W/L) of the n-channel MOS FET's 4 and 5. In order to set desired voltage by changing the ratio of (R2) and (R3) in the equation (8), it is only necessary to suitably select a ratio of (W/L) of the n-channel MOS FET 10 and (W/L) of the n-channel MOS FET 11.

Figure 4:
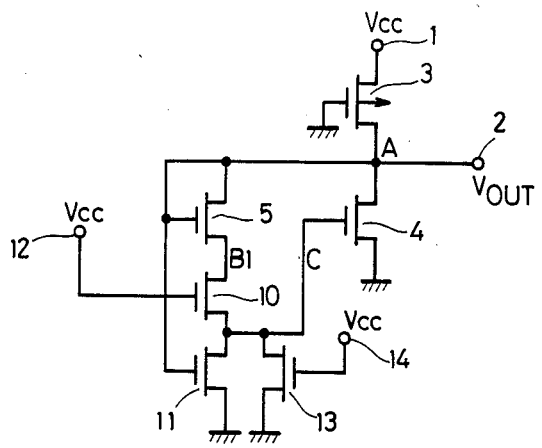
FIG. 4 is a circuit diagram showing a constant voltage generating circuit of another embodiment of this invention.

FIG. 4 is a circuit diagram showing a constant voltage generating circuit of another embodiment of this invention. In this circuit, output voltage $V_{OUT}$ instead of the power supply voltage $V_{cc}$ is applied to the gate of the n-channel MOS FET 11 of FIG. 3 and a n-channel MOS FET 13 is further provided between the gate of the n-channel MOS FET 4 and the grounding potential. To the gate of the n-channel MOS FT 13, power supply voltage $V_{cc}$ is applied from the power supply terminal 14. In the embodiment shown in FIG. 4, if the power supply voltage $V_{cc}$ increases, the impedance of the n-channel MOS FET 10 having the gate connected to $V_{cc}$ is lowered according to the increase of the power supply voltage $V_{cc}$, while the impedance of the n-channel MOS FET 11 having the gate connected to the output voltage $V_{OUT}$ does not change. As a result, in the equation (8), the ratio of (R2)/(R3) is decreased to compensate for an increment of $\alpha$ caused by the increase of the power supply voltage $V_{cc}$ and thus, the dependency of the output voltage $V_{OUT}$ on the power supply voltage $V_{cc}$ can be reduced. The n-channel MOS FET 13 serves to finely adjust the dependency of (R2)/(R3) on the power supply voltage and to prevent the node C and the node B1 from being stable at high potential and at low potential, respectively, as the result of the non conductive state of both of the n-channel MOS FET's 5 and 11.

Figure 5:
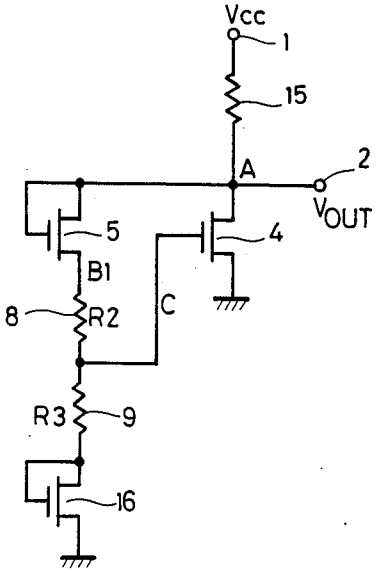
FIG. 5 is a constant voltage generating circuit of another embodiment of this invention.
Figure 6:
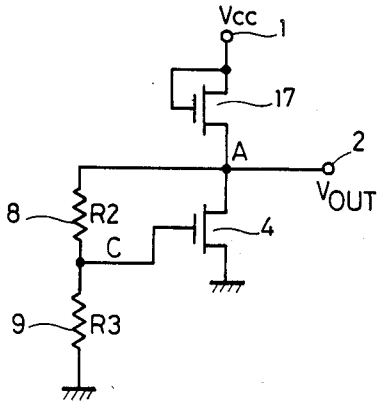
FIG. 6 is a circuit diagram showing a constant voltage generating circuit of another embodiment of this invention.

FIGS. 5 and 6 are circuit diagrams showing constant voltage generating circuits of other embodiments of this invention. Although in the embodiments shown in FIGS. 2 to 4, the p-channel MOS FET 3 is used as a pull-up element in the output portion, a resistor 15 of a polysilicon material as shown in FIG. 5 may be used or an n-channel MOS FET 17 as shown in FIG. 6 may be used alternatively.

In addition, as shown in FIG. 5, a n-channel MOS FET 16 having a gate connected to a drain may be interposed between the resistor 9 and the grounding potential or on the contrary, as shown in FIG. 6, the n-channel MOS FET 5 may be omitted from the output control portion.

Further, although in the above described embodiments, a positive power source is used and the output control portion is formed by n-channel MOS FET's, a negative power supply may be used and the output control portion may be formed by p-channel MOS FET's and in such a case, the same effects as in the above stated embodiments can be also obtained.

Although the present invention has been described and illustrated in detail, it is clearly understood that the same is by way of illustration and example only and is not to be taken by way of limitation, the spirit and scope of the present invention being limited only by the terms of the appended claims

What is claimed is:

1. A constant voltage generating circuit comprising:

a power supply terminal adapted to be connected to a power supply means, means for applying a reference potential, a voltage output terminal for providing regulated constant voltage, pull-up means connected between said power supply terminal and said voltage output terminal for pulling up output voltage, pull-down means connected between said reference potential supply means and said voltage output terminal and having a control terminal for pulling down output voltage, and at least two resistance means connected in series between said reference potential supply means and said voltage output terminal, a node between said at least two resistance means being connected to said control terminal of said pull-down means;

a ratio of the impedance of one of said resistance means connected to said voltage output terminal to the impedance of said another one of said resistance means connected to said reference potential supply means being controlled in an inverse relation to any change of voltage of said power supply means.

2. A constant voltage generating circuit in accordance with claim 1, wherein said pull-down means comprises a field effect transistor.

3. A constant voltage generating circuit in accordance with claim 1, wherein said at least two resistance means each comprise a field effect transistor having a control terminal connected to a voltage approximately equal to the voltage of said power supply means.

4. A constant voltage generating circuit in accordance with claim 1, wherein said one of said resistance means is a field effect transistor of a first polarity having a control terminal connected to said voltage ooutput terminal, and said another one of said resistance means is a field effect transistor of the first polarity having a control terminal connected to said power supply terminal.

5. A constant voltage generating circuit in accordance with claim 1, wherein said pull-up means is a resistor of a polysilicon material.

6. A constant voltage generating circuit in accordance with claim 1, wherein said pull-up means comprises a field effect transistor having a control terminal connected to said reference potential supply means.

7. A constant voltage generating circuit in accordance with claim 1, wherein said pull up means comprises a field effect transistor having a control terminal connected to said power supply terminal.

8. A constant voltage generating circuit in accordance with claim 1, further comprising a field effect transistor connected between the node of said at least two resistance means and said reference potential supply means and having a control terminal connected to said power supply terminal.

* * * * *